United States Patent [19]

Koves

[11] 4,335,812

[45] Jun. 22, 1982

[54] ARTIST'S SKETCH BOX TRAY AND CARRYING CASE FOR THE SAME

[76] Inventor: Thomas Koves, 645 N. Cherokee, Los Angeles, Calif. 90004

[21] Appl. No.: 149,709

[22] Filed: May 14, 1980

[51] Int. Cl.[3] ..... B65D 1/34

[52] U.S. Cl. ..... 206/1.8; 150/34; 224/205

[58] Field of Search ..... 206/1.7, 1.8, 224, 575; 224/202, 205, 250; 150/34

[56] References Cited

U.S. PATENT DOCUMENTS 2,717,620 9/1955 Renz ..... 150/34
2,867,928 1/1959 Angell ..... 206/1.8
3,053,005 9/1962 Byers ..... 224/205 X

*Primary Examiner*—Steven M. Pollard
*Attorney, Agent, or Firm*—Allan M. Shapiro

[57] ABSTRACT

Artist's sketch box tray is a rectangular tray with partitions for holding the artist's equipment. The tray can be vacuum-formed plastic, wood, metal or other comparable material, can be enclosed in a paper or transparent polymer tube for sale, and can be inserted into a carrying case to form a sketch box. The carrying case has a top closure for holding the equipment in the sketch box tray, a front pocket for pads and panels, straps for carrying wet or dry canvasses, and loops to carry a tripod easel so that all artist materials can be conveniently carried.

3 Claims, 7 Drawing Figures

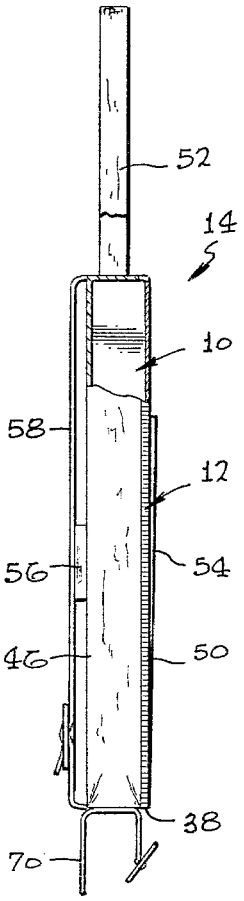
FIG. 4
FIG. 5
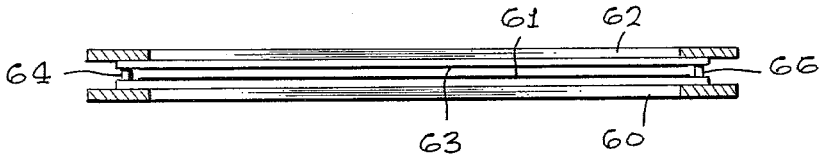
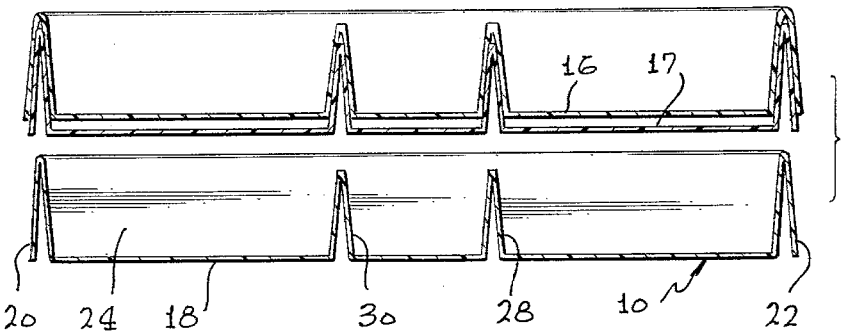
FIG. 6
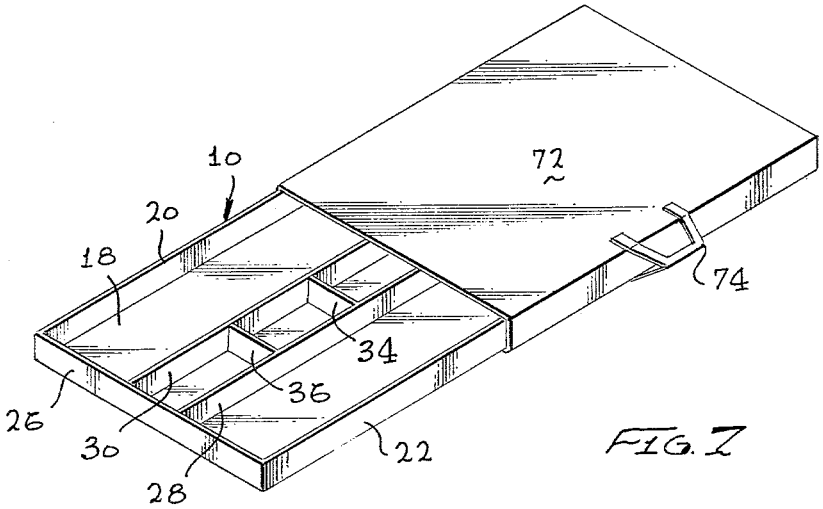
FIG. 7

ARTIST'S SKETCH BOX TRAY AND CARRYING CASE FOR THE SAME

BACKGROUND OF THE INVENTION

This invention is directed to an artist's sketch box tray having partitions separating the tray into spaces which are suitable for the various sizes and types of artist supplies. A carrying case for the tray both encloses the tray so that it becomes a sketch box and permits the carrying of other artist equipment in and on the carrying case.

The conventional artist's sketch box is a wooden box, including wooden partitions. The partitions are designed for carrying various pieces and types of artist equipment including media, brushes and the like. A hinged cover encloses the top of the sketch box to restrain the artist's equipment therein during transportation. The conventional artist's sketch box is very useful for its purpose and has not seen any substantial design improvements.

In view of the fact that it is made of wood and metal hardware and requires skilled construction and assembly, there is both expensive material and labor in producing such an artist's sketch box. Thus, there is need for a less expensive sketch box which accomplishes the same goals and, in the case of the present invention, also serves additional functions.

SUMMARY OF THE INVENTION

In order to aid in the understanding of this invention, it can be stated in essentially summary form that it is directed to an artist's tray and carrying case for the tray so that it forms a sketch box. The preferred sketch box tray is made of polymer composition material so that it can be economically produced. The carrying case encloses the sketch box tray to retain the artist's supplies therein and also has additional straps and fittings for the carrying of the case and for the carrying of other artist's supplies.

It is thus an object of this invention to provide an artist's sketch box tray which is suitable for receiving various media, supplies and tools of the artist, preferably as well as a sketch pad, with the sketch box tray being economically produced so that it can serve as a sales container for the artist's equipment. It is another object to provide an artist's sketch box tray which is formed of thermoplastic synthetic polymer composition material and is arranged so that it is stackable for economic storage before it is packed with artists' supplies. It is another object to provide an artist's sketch box tray with recessed partitions so that a sketch pad can be carried within the confines of the sketch box tray. It is a further object to provide a carrying case for such a sketch box tray where the carrying case has suitable pockets and attachment loops for the carrying of additional artists' supplies, as well as enclosing the sketch box tray within the carrying case. It is another object to provide a sketch box tray which can be made of a variety of convenient materials in an economical manner.

The features of the present invention which are believed to be novel are set forth with particularity in the appended claims. The present invention, both as to its organization and manner of operation, together with further objects and advantages thereof, may be best understood by reference to the following description taken in conjunction with the accompanying drawings.

BRIEF DESCRIPTION OF THE DRAWINGS

FIG. 4 is an end-elevational view of the artist's sketch box tray in its carrying case, with parts broken away and parts taken in section.

FIG. 5 is an enlarged section taken generally along the line 5—5 of FIG. 2.

FIG. 6 is a section across one of the artist's sketch box trays, showing it in stackable relationship to other sketch box trays shown in section.

FIG. 7 is an isometric view of one of the artist's sketch box trays, and showing it partially slid out of its enclosing sleeve.

DESCRIPTION OF THE PREFERRED EMBODIMENTS

Figure 1:
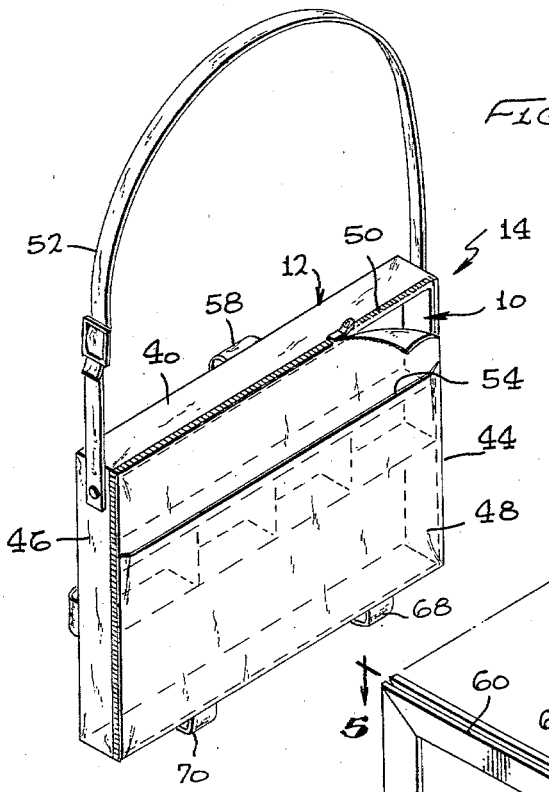
FIG. 1 is a perspective view of the artist's sketch box tray of this invention, enclosed in its carrying case, with the carrying case seen from the front side.

The assembly of the artist's sketch box tray 10 within its carrying case 12 is the sketch box assembly generally indicated at 14 in FIGS. 1, 2, 3 and 4. Sketch box tray 10 is shown in FIG. 6 in conjunction with already stacked identical sketch box trays 16 and 17 with which it is stackable. Sketch box tray 10 has bottom 18 and sides 20 and 22, as well as ends 24 and 26. Additionally, partitions 28 and 30 extend from one to the other, and cross partitions 32, 34 and 36 join the partitions 28 and 30 so that the several partitions, as well as the end walls and side walls define spaces for the receipt of artists' supplies. The partitions can be located in the spaces sized for particular sets of artists' supplies. The partitions are not quite as high as the side and end walls so that there is a shallow space over the entire sketch box, within its side and end walls and above the partitions, which can receive a sketch pad or the like. As is seen in FIG. 6, the walls and partitions of the preferred embodiment of the sketch box tray are V-shaped so that the sketch box trays can be stacked when empty. In one preferred embodiment, the entire structure is of plastic polymer composition material and preferably designed to be of uniform thickness so that it can be vacuum-molded. In other preferred embodiments, the entire structure is of metal, fibre-board, cardboard, laminated paper or similar materials which can be stamped or pressed into the described shape.

Carrying case 12 is especially designed for the receipt and carrying of sketch box tray 10. Carrying case 12 is made of flexible material such as leather-like vinyl so that the carrying case 12 is in firm rectangular condition when the sketch box tray is positioned therein to form a sketch box assembly 14. Carrying case 12 has bottom 38 which is formed with sides 40 and 42 and ends 44 and 46. Top or cover 48 is permanently attached to side 42, but zipper 50 extends around the ends 44 and 46 as well as side 40 so that top cover can be swung out of the way for full access to the sketch box tray 10 housed therein. Instead of a zipper, another detachable fastening means could be used. Shoulder carrying strap 52 is attached to ends 44 and 46, as by rivets, so that the sketch box assembly 14 carrying case with sketch box comprising tray 10 housed therein, and including the artists' supplies carried in the sketch box can be easily and conveniently carried, and ready access is achieved to the contents. A sketch pad is carried in sketch box tray 10 over the partitions, and in addition, front pocket 54, formed by a double thickness over part of the top 48, can be used for receiving and carrying smaller pads, boards, canvessette, or masonite panels.

Figure 2:
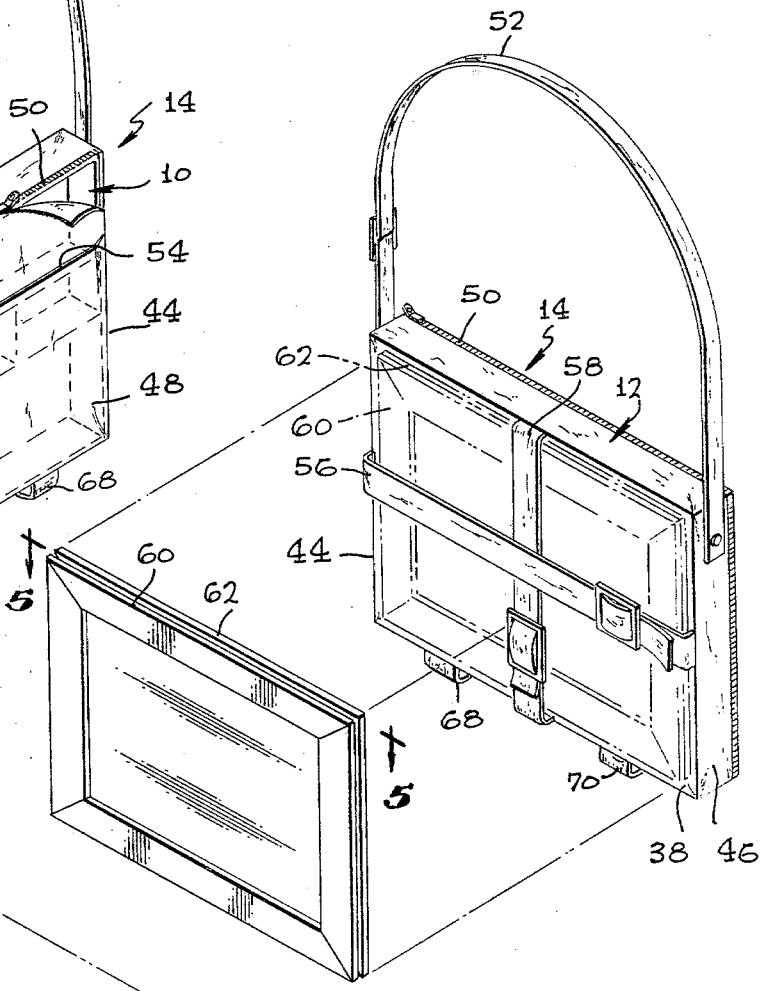
FIG. 2 is similar to FIG. 1, but showing the back of the carrying case and showing the wood frame canvasses in separated position.
Figure 3:
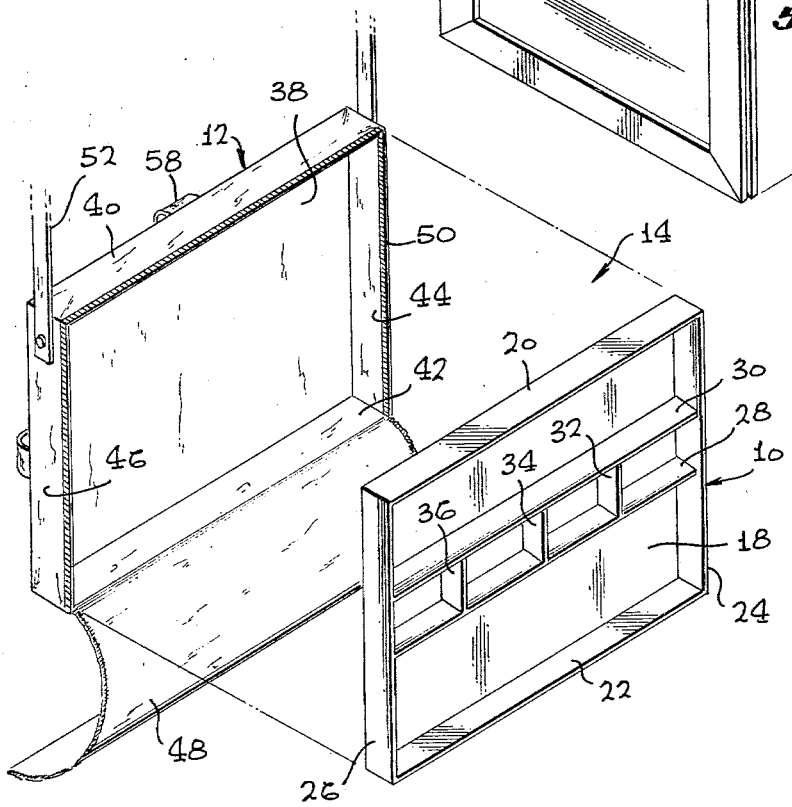
FIG. 3 is a view similar to FIG. 1, showing the carrying case in the open position with the artist's sketch box tray in an exploded position.

The back of carrying case 12 has two tie-down straps 56 and 58 at right angles to each other. They are equipped with buckles and are of suitable length so that they can engage around two wood framed canvasses. Canvasses 60 and 62, with their wood frames, are illustrated in FIGS. 2 and 5. Canvasses 60 and 62 are positioned in face-to-face relationship, and when either or both of their respective faces 61 and 63 is wet, they are spaced from each other by four canvas pins adjacent the corners of the canvasses. The canvas pins 64 and 66 are illustrated in FIG. 5 and two additional such pins are located at the other corners. The canvas pins are supplied in the fully furnished sketch box and comprise spacer heads with sufficient pin extending therefrom to secure the canvas pins in place. When positioned in the illustrated face-to-face relationship, the canvasses can be strapped to the back of carrying case 12 as illustrated in the right-hand portion of FIG. 2.

Easel straps 68 and 70, see FIGS. 1, 2 and 4, are buckle straps of suitable length for engagement around a tripod easel. In this way, the tripod easel can be carried along to complete the equipment required by the artist in the field. Paints, brushes, pens, pencils, sponges, drawing pads, tripod easel and two wet canvasses can be quickly and easily transported to or from studio, office, classroom, or the field. Sketch box tray 10 is shaped and partitioned so that it holds all the standard sized media as well as turpentine and polymer bottles, brushes, knives, charcoal, pencils, and any other accessories that the artist needs.

Sketch box tray 10 is a tray which can be used in merchandising a complete beginner's set of artists' materials. In such a case, rectangular tubular sleeve 72, see FIG. 7, is employed with tray 10. Sleeve 72 is tubular and has an interior dimension such that the filled sketch box tray 10 can be housed therein. Sleeve 72 may be closed on one end and may either be transparent to show the contents of the sketch box or may be printed with figures and descriptive words describing the contents. Sleeve 72 can be designed so that it serves as a cover to restrain the contents within sketch box tray 10 until a more sophisticated carrying case 12 is acquired. Sleeve 72 is preferably provided with handles 74 so that it can be carried to the artistic site for use.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A carrying case for an artist's sketch box tray, said carrying case comprising:

a bottom, first and second side walls and first and second end walls secured to said bottom around the edges thereof;

an openable top, said openable top having a zipper thereon and being attached to said walls by said zipper when in a closed position and being detachable by said zipper from three of said walls in the open position, said top having a double thickness over a portion thereof to define a pocket in said top;

a carrying strap attached to said ends of said carrying case for the carrying thereof;

first and second tiedown straps secured to said case and extending across the exterior of said bottom thereof, one of said straps being secured at its ends on said first and second side walls and the other of said straps being secured at its end to said first and second end walls, said tiedown straps being oriented at substantially right angles with respect to each other and being for the carrying of canvases adjacent the exterior of said bottom case;

first and second easel straps secured to said second side wall for securement of a tripod easel to the exterior of said carrying case, said bottom, walls and top enclosing a space suitable to receive an artist's sketch box tray to retain an artist's sketch box tray and its artist's materials when said top is closed, and to permit access thereto when said top is open.

2. A carrying case having an artist's sketch box tray therein, said carrying case comprising:

a bottom, first and second side walls and first and second end walls secured to said bottom around the edges thereof;

an openable top attached to one of said walls, a zipper detachably engaging said top to the other of said walls to provide a closed position; and being detachable to provide an open position;

a first attachment strap attached to said end walls and extending around said bottom of said carrying case, a second attachment strap attached to said first and second side walls and extending around said bottom of said case so that an artist's canvas can be detachably secured by said attachment straps to the exterior of said bottom for the carrying of an artist's canvas thereon, said bottom, said walls and said top enclosing a space therein;

a sketch box tray enclosed therein, said sketch box tray having a bottom, first and second side walls and first and second end walls attached to said bottom and attached to each other to form walls around said bottom, said bottom and said walls of said sketch box tray lying adjacent said bottom and said walls of said carrying case;

at least first and second partitions attached to said bottom and attached to two of said walls to divide the interior of said sketch box into spaces suitable to receive artists' supplies and equipment, said partitions being formed as an inverted open V so that when said sketch box trays are empty, a plurality of said sketch box trays can be nested, said partitions extending a shorter distance from said bottom than said walls so that a sketch pad can overlie said partitions and extend no higher than said walls so that said sketch box tray can contain artists' materials and a pad thereon and said top of said carrying case can be closed to retain said sketch box tray and its artists' materials, and said top can be opened to permit access to said sketch box tray and artists' materials therein.

3. The carrying case of claim 2 wherein said carrying case is made of leather-like vinyl.

* * * * *